US005271668A

United States Patent [19]

Carlson

[11] Patent Number: 5,271,668

[45] Date of Patent: Dec. 21, 1993

[54] MATERIAL CONTAINMENT ENCLOSURE

[75] Inventor: David O. Carlson, Tesuque, N. Mex.

[73] Assignee: The United States of America as represented by the United States Department of Energy, Washington, D.C.

[21] Appl. No.: 678,387

[22] Filed: Apr. 1, 1991

[51] Int. Cl.[5] ..... A61G 11/00

[52] U.S. Cl. ..... 312/1

[58] Field of Search ..... 312/1, 3, 31.2, 352, 312/239

[56] References Cited

U.S. PATENT DOCUMENTS 3,498,687 3/1970 Diccianni ..... 312/1

FOREIGN PATENT DOCUMENTS 1342078 9/1963 France ..... 312/239

0931431 7/1963 United Kingdom ..... 312/239

*Primary Examiner*—Kenneth J. Dorner

*Assistant Examiner*—Gerald A. Anderson

*Attorney, Agent, or Firm*—Richard J. Cordovano; Paul D. Gaetjens; William R. Moser

[57] ABSTRACT

An isolation enclosure and a group of isolation enclosures useful when a relatively large containment area is required. The enclosure is in the form of a ring having a section removed so that a technician may enter the center area of the ring. In a preferred embodiment, an access zone is located in the transparent wall of the enclosure and extends around the inner perimeter of the ring so that a technician can insert his hands into the enclosure to reach any point within. The inventive enclosures provide more containment area per unit area of floor space than conventional material isolation enclosures.

5 Claims, 2 Drawing Sheets

MATERIAL CONTAINMENT ENCLOSURE

BACKGROUND OF THE INVENTION

This invention relates to the field of isolation and containment of hazardous materials and sensitive materials. This invention is the result of a contract with the Department of Energy (Contract No. W-7405-ENG-36).

Numerous substances must be isolated from the atmosphere and from contact with people, yet must be accessible for manipulation by humans. These materials include radioactive substances, toxic substances, and certain biological materials. Hoods and gloveboxes are often used to contain and isolate these materials when they must be handled, though certain highly radioactive materials must be isolated behind leaded glass as much as 50 cm thick and handled by remotely operated mechanical manipulators. The most common containment or isolation apparatus is a laboratory hood having an entirely open front and an exhaust fan connected to the rear or top of the hood. The fan causes air to flow into the hood from the open front toward the fan connection, thus tending to sweep material away from a technician facing the open front of the hood.

Gloveboxes are well known enclosures for isolating hazardous materials, particularly when radioactive materials must be handled. These boxes are completely sealed from the atmosphere and have gloves with long cuffs, or extensions, located inside the enclosure and connected to a wall of the enclosure. A small air flow through the box is usually maintained and both air entering the box and air leaving the box passes through HEPA filters. A technician inserts his hands and forearms into the cuffed gloves and then can manipulate materials and apparatus inside the box. Where the need for isolation is less critical, "open-front gloveboxes," or open-front containment boxes, may be used. Though the term "open-front glovebox" is inaccurate, it is commonly used. For example, a standard glovebox may be used for radioactive substances in the form of powders while an open-front glovebox is used for radioactive solutions. An open-front containment box is an enclosure having an opening without gloves attached to it through which a technician may insert his hands and, if necessary, his forearms to handle material within the box. The technician will normally be wearing protective clothing, such as gloves and a smock. An open-front glovebox is much more convenient to use than a conventional glovebox and its use allows a technician to work more rapidly. An open-front glovebox is normally maintained at a pressure slightly below atmospheric pressure by means of a fan which exhausts the air passing through the glovebox to the atmosphere. In most cases, a filter is provided at some point between the fan inlet and outlet to prevent toxic material which is pulled from the glovebox by the fan from entering the atmosphere.

In the manufacture of pharmaceuticals and electronic components such as chips, it is necessary to protect the product from airborne contamination. This is normally accomplished by working in "clean rooms" in which the air pressure is greater than atmospheric pressure so that air flows out of the rooms. The air provided to a clean room must be filtered and people entering a clean room must completely cover their normal clothing with smocks or "bunny suits" which do not shed particulate matter and often must wear face masks. For certain small scale operations, a containment box which is operated at a positive pressure by means of supplying clean air to it may be used instead of a clean room.

The present invention is useful in either situation: where the material handled is toxic or where the material handled must be protected from atmospheric contamination. It is applicable to both conventional gloveboxes and open-front containment or isolation enclosures. It was developed in the course of design of a facility requiring several hundred open-front gloveboxes.

SUMMARY OF THE INVENTION

The invention is an isolation enclosure and a group of isolation enclosures useful when a relatively large containment area is required. The enclosure is in the form of a ring having a section removed so that a technician may enter the center area of the ring. In a preferred embodiment, an access zone is located in the transparent wall of the enclosure and extends around the inner perimeter of the ring so that a technician can insert his hands into the enclosure to reach any point within. The inventive enclosures provide more containment area per unit area of floor space than conventional material isolation enclosures.

It is an object of this invention to provide an isolation enclosure configuration which requires less area in a building as compared to prior art enclosures.

It is also an object of this invention to provide increased technician efficiency by reducing the technician movement required in order to reach all portions of a containment area.

It is a further object of this invention to reduce the area of a laboratory which is vulnerable to contamination resulting from a technician moving between enclosures.

BRIEF DESCRIPTION OF THE DRAWINGS

FIG. 1 is a plan view of material isolation enclosures in a prior art configuration and arrangement. The hatched represents the tops of the enclosures.

FIG. 2 is a plan view of the inventive material isolation enclosures. The hatched portion represents the tops of the enclosures.

FIG. 3 is an end view of the inventive enclosures which is taken as shown by the section arrows of FIG. 2. Section arrows are also shown in FIG. 1 because FIG. 3 also depicts a cross sectional configuration of prior art enclosures.

DETAILED DESCRIPTION OF THE INVENTION

Figure 1:
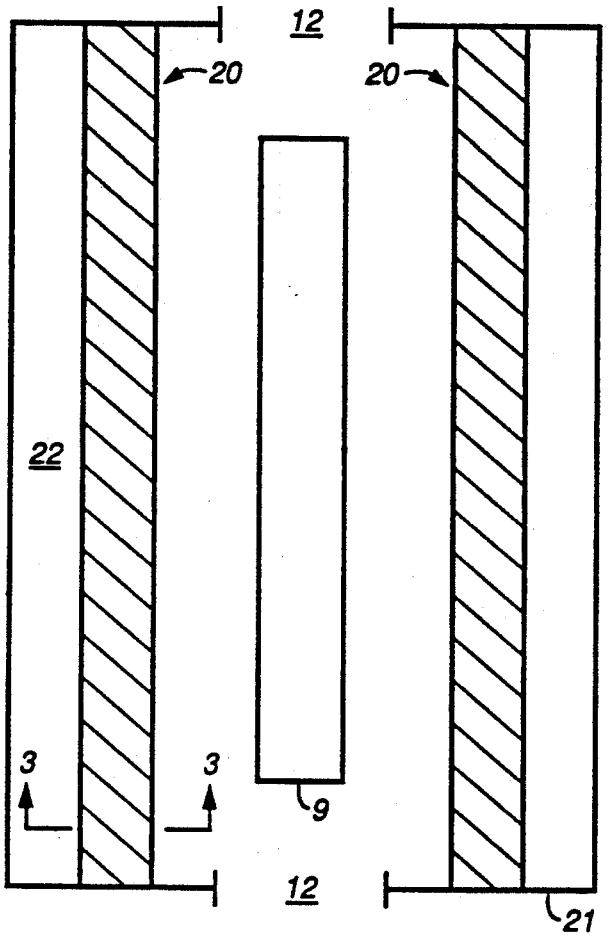
Fig. 1 Prior Art
FIGS. 1–3 are schematic representations which are intended to assist in explaining the invention and are not intended to serve as detailed engineering drawings.
Figure 3:
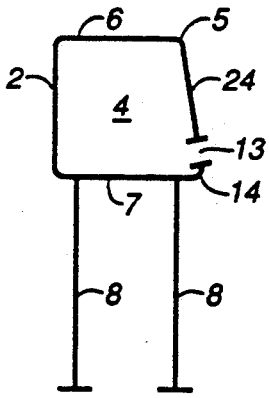

FIG. 1 is a plan view of conventional material isolation enclosures 20 in a room whose perimeter is denoted by reference number 21. A laboratory bench 9, or a group of tables, is located in the space between enclosures 20. The doorways of the room are shown by reference numbers 12; doors are not shown but would usually be provided. Enclosure 20 may be a single enclosure which extends the entire length of the room or may have internal walls which divide it into a series of small enclosures. Enclosure 20 may be completely separate material isolation enclosures which are standing end to end in the room. Though FIG. 3 is provided to show an end view of the material isolation enclosures of FIG. 2, it can also serve to provide an end view of an enclosure of FIG. 1. It is taken as shown by section arrows labeled 3. The enclosure has a floor 7, a ceiling 6, side walls 2 and 24 and rests on legs 8. A technician may insert his hands inside the enclosure through access zone 13.

Figure 2:
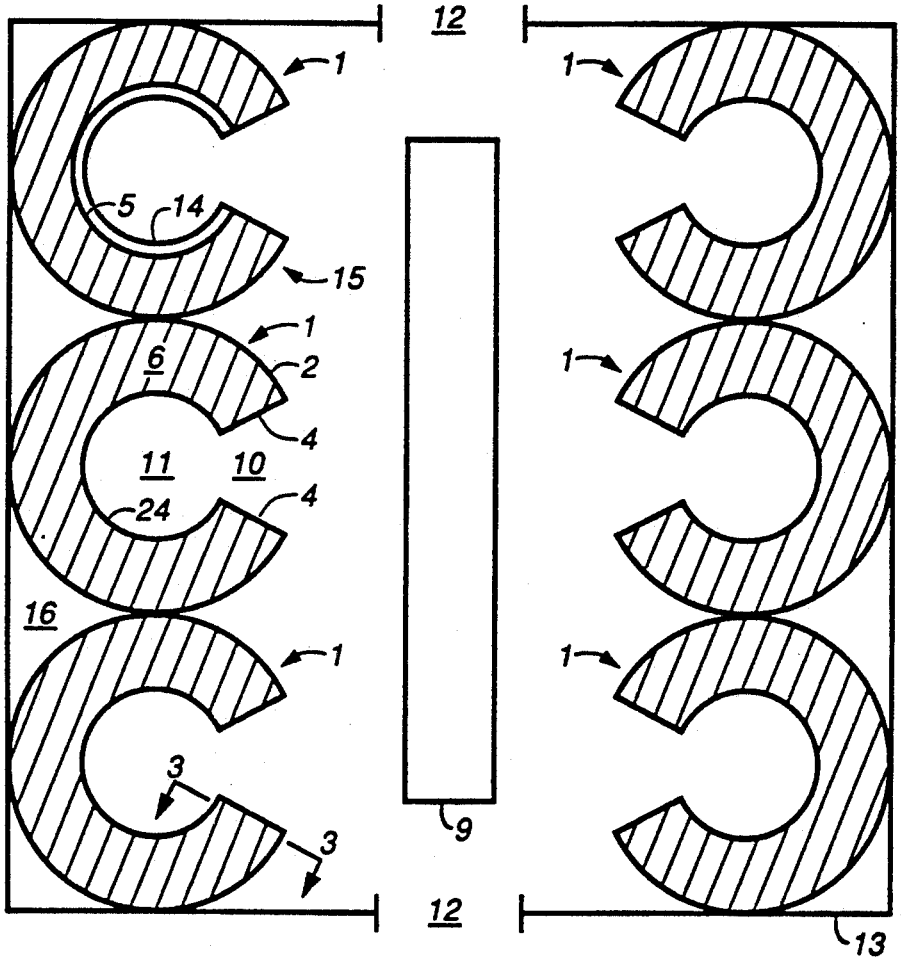

FIG. 2 is a plan view of 6 separate material isolation enclosures 1 which are located inside a room whose perimeter is denoted by reference FIG. 13. Doorways are denoted by reference number 12; doors are not shown but would usually be provided. Laboratory bench 9, or several tables, is located in the space between the two parallel rows of material isolation enclosures. Each enclosure is in the form of a ring which has a section removed to provide an access opening 10 so that a technician may enter the center area of the enclosure, which is designated by reference number 11. The access openings are facing one another. FIG. 3 is a view of an isolation enclosure 1 which is taken as shown by the section arrows denoted 3. Referring now to both FIGS. 2 and 3, each enclosure 1 is comprised of a floor 7 which is in the form of a ring having a section removed, and a ceiling 6 which is also in the form of a ring having a section removed, where the ceiling section corresponds to the removed floor section in that the floor and ceiling are parallel to one another and the gap on the ceiling ring is directly above the gap of the floor ring. Outer wall 2 is vertically oriented and connects the outer perimeter of the floor with the outer perimeter of the ceiling. Inner wall 24 connects the inner perimeter of the floor with the inner perimeter of the ceiling and is slightly inclined from the vertical. For drawing convenience, this inclination is shown only in the schematic of the enclosure denoted by reference number 15. Reference number 5 denotes the upper corner of the enclosure and reference number 14 denotes the lower corner of the enclosure. Two end walls 4 close off the ends of the enclosure at the point where the ring has a gap which allows a technician access to the center of the ring.

In a preferred embodiment, access zone 13 is an opening in the lower portion of inner wall 3 so that a technician can insert his hands into the enclosure to manipulate materials and apparatus located inside the enclosure. The access zone extends around the entire inner perimeter of the enclosure. Instead of the access zone being open, it may be closed and have gloves located at intervals. At least a portion of inner wall 24 is transparent so that an operator can view the entire interior of the containment enclosure.

In a preferred embodiment, the outer diameter of the enclosure is 8 feet and the inner diameter is 4 feet; thus, the depth of the box is 2 feet. The enclosure is normally mounted on legs so that the floor of the enclosure is about 40 inches high, so that a technician may stand in front of the enclosure and work inside it. Though the height of conventional boxes is usually greater than 2 ½ feet, there is little reason to provide a height greater than about 24 inches since any enclosure area above about 24 inches is not utilized. The gap, or the section of the ring which is removed, is about 60 degrees, that is, about 1/6 of the ring is removed to allow for technician access. Thus, the arc of the enclosure is 300 degrees.

Referring now to both FIGS. 1 and 2, lab bench 9 is used to hold materials which are placed into and taken out of the enclosures. Material isolation enclosures are often provided with utilities such as electrical power and compressed air and often are connected to air handling equipment by ducts connected to the rear of the enclosures. Reference number 16 of FIG. 2 and reference number 22 of FIG. 1 denote areas representative of service areas behind the enclosures where these connections are made.

To compare the space saved by using the inventive enclosures, the arrangement shown in FIG. 2 is compared to that of FIG. 1. The room of FIG. 2 is 24 feet×24 feet and the FIG. 1 room is 24 feet×18.5 feet. In each case, the laboratory bench is the same size and there is at least 3 feet clearance between the lab bench and the enclosures. The prior art enclosures are 24 inches deep and a service area of 24 inches is provided behind the enclosure.

The area of one inventive enclosure floor is $$(300/360)\ (\pi 4^2-\pi 2^2)=31.4 \text{ square feet.}$$

The ratio of total containment area to room area is $$(6\times 31.4)/(24\times 24)=0.327.$$

The area of the enclosures shown in FIG. 1 is $$2\times 2\times 24=96 \text{ square feet.}$$

The ratio is $96/(24\times 18.5)=0.216$.

Comparing the two ratios, $$0.327/0.216=1.51.$$

It can be seen that the use of the invention, in this example, improves the utilization of space in a building by a factor of greater than 50%. One may postulate various arrangements with various dimensions of both the inventive enclosure and the prior art enclosure; however, it is believed that practice of the present invention will always result, in a fair comparison, in better space utilization.

It can be seen that practice of the invention increases the efficiency of a technician, since he has access to all of the space in an inventive enclosure by moving just a few feet, as compared to moving along a long row of enclosures as shown in FIG. 1.

Where radioactive material is being handled, a radiation detector would be located at the access opening of an inventive enclosure. If a technician becomes contaminated, this would become known before he leaves the small area in the center of the enclosures. In the prior art arrangement of FIG. 1, radiation detectors would be located at the doors, so that a technician contaminated with radiation could contaminate the whole room before the problem is discovered.

What is claimed is:

1. An isolation enclosure in the form of an incomplete ring, which has surrounded by said enclosure, where said enclosure is comprised of:

a. a floor which is in the form of an incomplete ring, where said floor has an outer perimeter and an inner perimeter;

b. a ceiling which is in the form of an incomplete ring, where said ceiling has an outer perimeter and an inner perimeter;

c. an outer wall connecting the outer perimeter of the floor with the outer perimeter of the ceiling;

d. an inner wall connecting the inner perimeter of the floor with the inner perimeter of the ceiling and having an access zone which is located in a lower portion of said inner wall and extends around the entire inner perimeter of the enclosure, where at least a portion of said inner wall is transparent; and e. two end walls, each of which is attached to said floor, ceiling, outer wall, and inner wall to close the ends of said enclosure.

2. The isolation enclosure of claim 1 where said outer wall has a diameter of about 8 feet and said inner wall has a diameter of about 4 feet, so that the depth of said enclosure is about 2 feet.

3. The isolation enclosure of claim 1 where said removed section constitutes 60 degrees of said ring.

4. The isolation enclosure of claim 1 having a height of about 24 inches.

5. The isolation enclosure of claim 1 having transparent panels in said ceiling to admit light to the enclosure.

* * * * *